US005901982A

United States Patent [19]

Cooper

[11] Patent Number: 5,901,982

[45] Date of Patent: May 11, 1999

[54] COUPON HOLDER AND ORGANIZER

[76] Inventor: Margaret M. Cooper, 10161 Jim Tom Cir., Wilmer, Ala. 36587

[21] Appl. No.: 08/820,578

[22] Filed: Mar. 19, 1997

[51] Int. Cl.[6] ..... B42D 3/18

[52] U.S. Cl. ..... 281/31; 283/56; 283/51; 40/124.2

[58] Field of Search ..... 40/124.2, 776, 40/765, 700; 281/31, 32, 38; 402/79, 80 P, 80 R; 283/56, 51; D19/32, 33; D3/35; D6/626; 206/455, 472

[56] References Cited

U.S. PATENT DOCUMENTS

| | | | |
|---|---|---|---|
| 2,305,443 | 12/1942 | Pinto . | |
| 2,879,774 | 3/1959 | Siegel . | |
| 3,858,790 | 1/1975 | Humphrey . | |
| 4,002,355 | 1/1977 | Sendor | 281/31 X |
| 4,058,916 | 11/1977 | Whyatt | 40/107 |
| 4,312,393 | 1/1982 | Green | 206/425 X |
| 4,356,649 | 11/1982 | Diamond et al. | 40/405 X |
| 4,419,837 | 12/1983 | Meeker | 40/405 X |
| 4,571,867 | 2/1986 | Williams | 40/405 |
| 4,824,273 | 4/1989 | Silva et al. | 402/79 |
| 4,832,372 | 5/1989 | Young | 281/31 |
| 4,932,520 | 6/1990 | Ciarcia et al. | 281/31 X |
| 4,938,402 | 7/1990 | Anatra et al. | 224/277 |
| 5,048,736 | 9/1991 | Anatra | 224/277 |
| 5,305,935 | 4/1994 | Weiner | 224/277 |
| 5,351,813 | 10/1994 | Golovan | 206/45.34 |
| 5,387,037 | 2/1995 | Daitch | 383/7 |
| 5,431,449 | 7/1995 | Arimoto et al. | 281/31 |
| 5,480,192 | 1/1996 | Angerbauer et al. | 281/31 |
| 5,489,120 | 2/1996 | Thornsburg | 281/31 X |
| 5,501,540 | 3/1996 | Ho | 281/38 X |
| 5,765,875 | 6/1998 | Rowley | 283/74 |

*Primary Examiner*—Frances Han
*Attorney, Agent, or Firm*—Patent & Trademark Services; Joseph H. McGlynn

[57] ABSTRACT

An improved device for storing and organizing coupons which comprises a ringed binder that contains a number of panel inserts. Each panel having two or more columns of variously sized, transparent pockets disposed thereon. An additional, upper pocket is attached to a flexible piece at the inside cover of the organizer. The upper pocket may be extended to a position outside the binder to increase visibility and accessibility of certain items. Index tabs are provided on additional panels to facilitate organization of stored items. Desired items may therefore be accessed quickly and without the need to remove or sift through other items.

10 Claims, 2 Drawing Sheets

COUPON HOLDER AND ORGANIZER

BACKGROUND OF THE INVENTION

The present invention relates generally to devices for holding coupons, and in particular to a coupon binder having pockets, flaps, and index tabs for improved organization and storage of store coupons and similar items.

DESCRIPTION OF THE PRIOR ART

Conscientious shoppers often use coupons to obtain discounts on various grocery store items. For coupon enthusiasts, carrying and organizing their coupons often presents a challenge. Coupons tend to become disorganized and damaged in the process of shopping, which discourages some shoppers from using them. Various devices are known which can be used to carry and organize coupons, but these inventions suffer from several drawbacks.

For example, U.S. Pat. Nos. 4,938,402 and 5,048,736 describe coupon holders having receptacles joined by an upper arcuate member, which are designed to be received on the handle of a shopping cart. These inventions do not provide an adequate means to organize the coupons. To use these inventions, one would likely have to retrieve the entire contents of the receptacles to search for the desired coupon.

U.S. Pat. No. 5,305,935 discloses a coupon holder comprising a plurality of coupon pockets attached to rings, which can be connected to the handle of a shopping cart. This invention does not enable the user to view a plurality of coupons simultaneously. Also, it does not provide an adequate system of organization for different coupons.

U.S. Pat. No. 5,387,037 describes an accordion-type, pocketed folder for coupons, having a means to attach the folder to the handle of a shopping cart. This invention likewise does not enable the user to view a plurality of coupons simultaneously. It also requires the user to retrieve all the items from a particular pocket to select the desired coupons.

There remains a need in the art for a coupon holder which provides a detailed organization system for coupons. There also remains a need for a coupon holder which enables the user to access desired coupons quickly, without the need to retrieve a plurality of items in the process. The present invention, described in detail below, provides an improved device for holding and organizing coupons or other items. The invention overcomes all of the disadvantages described above, and provides additional advantages not afforded by the inventions heretofore disclosed.

SUMMARY OF THE INVENTION

The present invention is an organizing container for store coupons and similar items, comprising a ringed binder with a plurality of panel inserts. Each panel insert has a number of transparent pockets disposed thereon, said pockets being arranged in two or more columns. The pockets in each column are of different dimensions than those in the remaining columns, providing for storage of differently sized items. The top mounted flip over pocket would be attached to the front cover by a plastic flap and could be flipped out of the interior of the binder for easy access to coupons. Coupons to be used that day could be placed inside the flip over pocket for easy access at the register. Each panel is further provided with index tabs, enabling the user to access specific items quickly and easily. The invention provides the user with a means to store, organize, and access a large number of variously sized coupons. The invention also allows the user to view a large number of coupons simultaneously, and provides protection for the stored items.

Accordingly, it is an object of this invention to provide an improved container for coupons and similar items.

It is a further object of this invention to provide a container for coupons and the like which can be used to organize and store a large number of variously sized items.

It is still further an object of this invention to provide a container for coupons and the like which enables the user to view and to access a number of coupons simultaneously.

These and other objects and advantages of the present invention will become readily apparent from the detailed description below, when taken in conjunction with the annexed drawings.

DESCRIPTION OF THE PREFERRED EMBODIMENT

Figure 1:
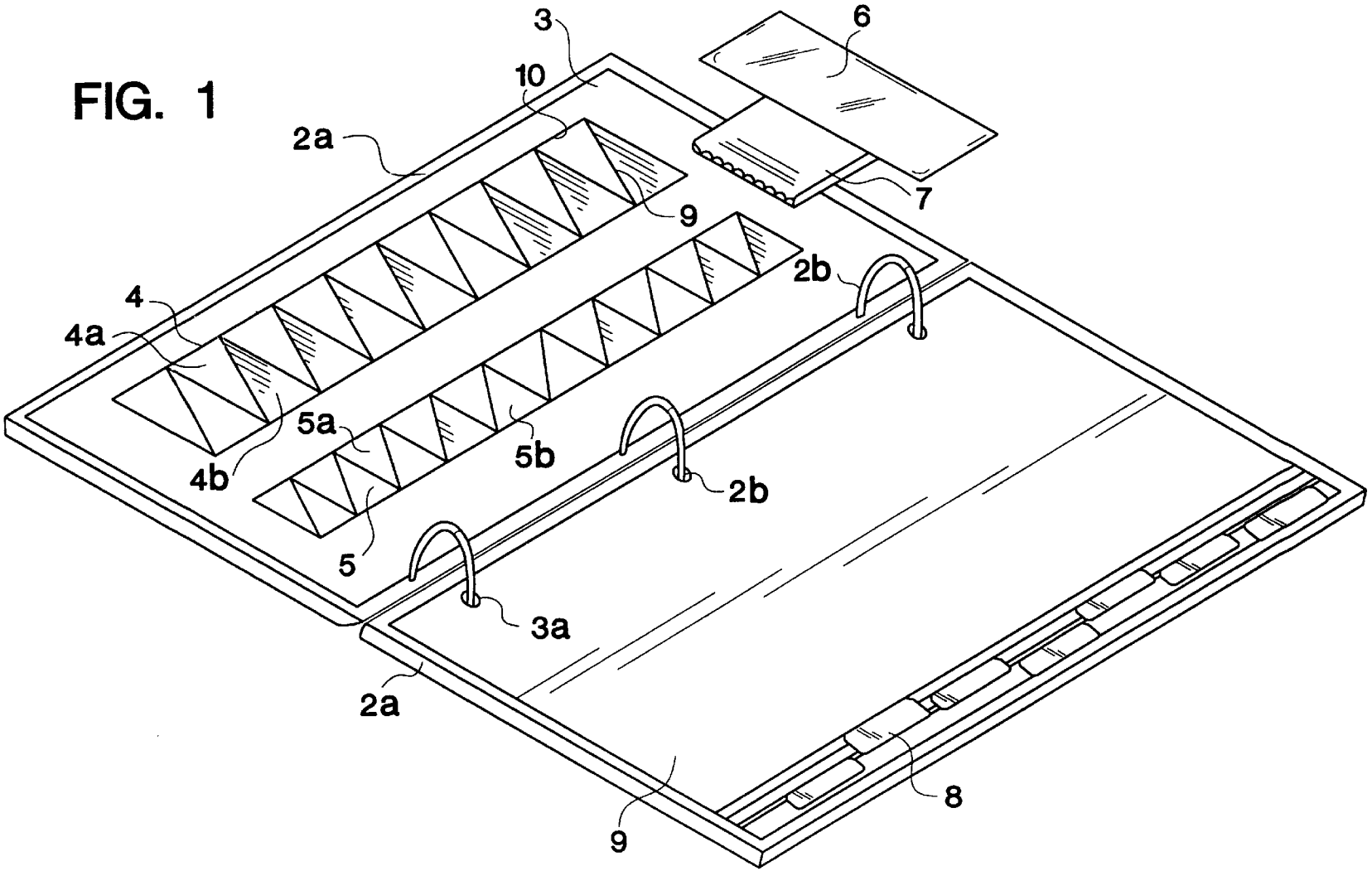
FIG. 1 is a perspective view of the coupon container in the fully opened position.
Figure 2:
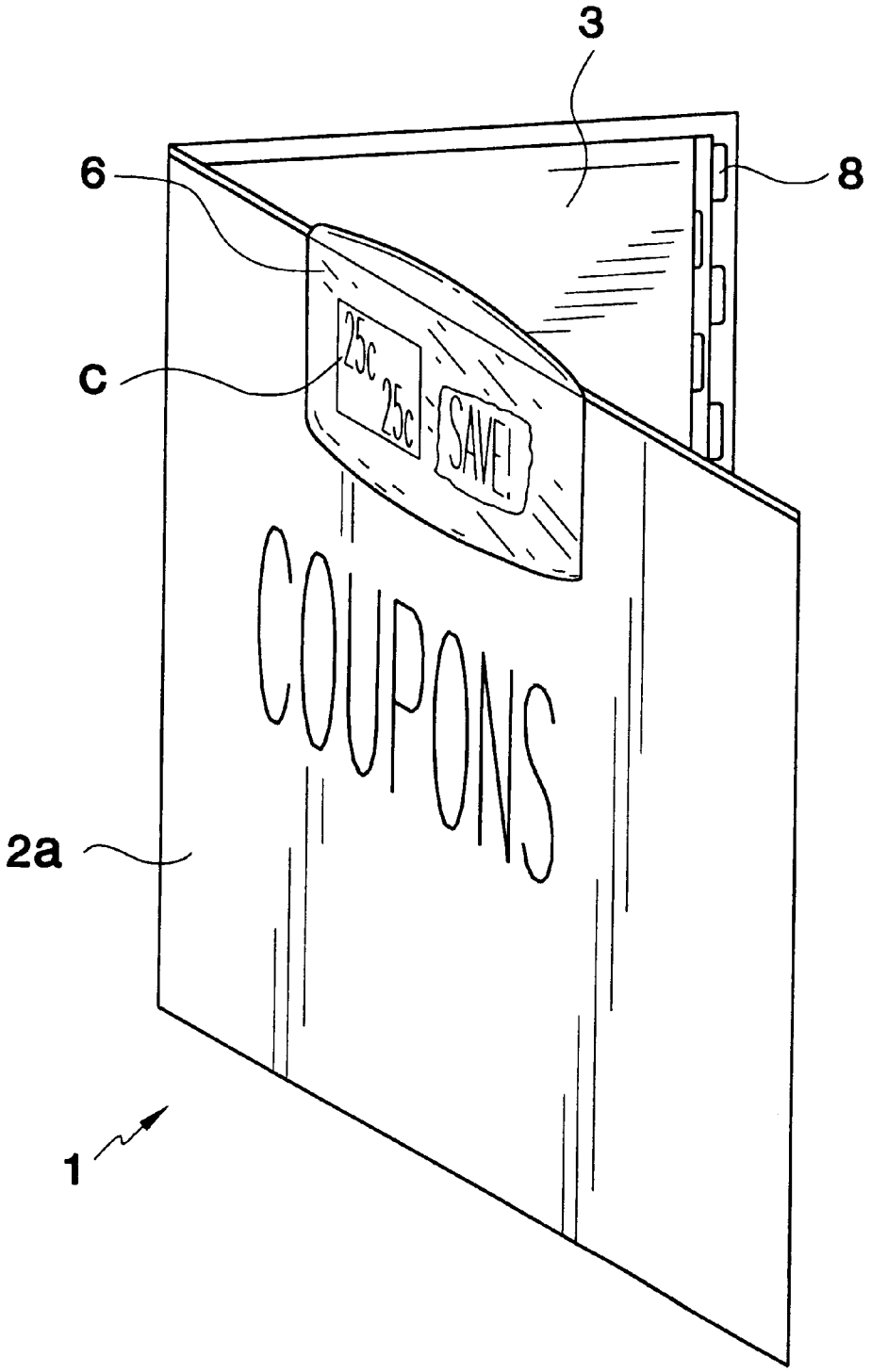
FIG. 2 is a perspective view of the coupon container, with the coupon container set upright and in a partially opened position.

Referring now to the drawings in greater detail, it can be seen in FIGS. 1 and 2 that the present invention 1 comprises a ringed binder. The binder is of a type known in the art, having rigid, folding cover portions 2*a* and centrally disposed ring members 2*b*. Ring members 2*b* preferably are of the split ring-type known in the art, which can be opened to receive three-holed paper and securely fastened to hold items inside the cover 2*a*. The cover portions 2*a* may be constructed from vinyl- or canvas-covered cardboard, or any other suitable material. Also, the number of rings is optional and more or less than the three rings shown could be used.

As shown in FIG. 1, the binder contains a number of panels 3. The panels 3 may be constructed from vinyl or plastic-covered cardboard, or any other suitable material. Holes 3*a* along the lateral margin of each panel 3 receive the ring members 2*b* to hold the panels within the binder.

As shown in FIG. 1, each panel 3 has a plurality of pockets 4, 5 disposed in columns on the surface thereof. The pockets in one column 4 are larger than those in the other column 5, providing for storage of variously sized items. The pockets 4, 5 are preferably constructed from pleated, transparent pieces of vinyl or plastic, and may be heat welded or otherwise securely fastened to the surface of the panels 3. Preferably, the front faces 4*a*, 5*a* of the pockets 4, 5 have downwardly angled upper margins 9, providing easier access to the corners of stored coupons, since the upper corner of the coupon will not be covered by the front faces 4*a*, 5*a* of the pockets 4, 5. Also, the back face 4*b*, 5*b* of each of the pockets 4, 5 should overlap slightly the bottom pleat of the pocket immediately above as shown by the dotted line 10 in FIG. 1. Such overlap causes the top of the pockets 4, 5 to angle slightly outward relative to the surface of the panel 3, making insertion of coupons and other items easier.

An additional, upper pocket 6 is attached at the top of the inside of the cover 2A. As shown in FIG. 1, the upper pocket 6 is connected to a flexible connecting piece 7 which is attached to the inside of cover 2A. The upper pocket 6 is constructed from the same materials as the pockets 4, 5 described above. The flexible piece 7 may consist of plastic, vinyl, or any suitable material, and may be heat welded or otherwise securely fastened inside the cover 2A and to the upper pocket 6. As shown best in FIG. 2, the upper pocket 6 may be positioned to extend outside the binder 2. The upper pocket 6 may thus be used to provide easier access to coupons c being used that day to make access easier at the register.

As shown in FIG. 1, the coupon collector has a plurality of pages or panels 9 which have index tabs 8 disposed on the lateral edge thereof. The index tabs 8 are positioned so that each tab 8 is visible, with no index tab 8 overlapping or otherwise obscuring any other. The index tabs 8 may be marked with notations, such as "cereal", "bread", etc., to provide easy retrieval of desired coupons. The pages or panels 9 can be used to separate the panels 3 so a user can use the index tabs to turn quickly to a panel 3 which has the desired coupons.

The usefulness and advantages of the present invention 1 for storing and organizing coupons and the like will now be appreciated. Coupons placed in the pockets 4, and 5 are clearly visible and accessible to the user, since the pockets are transparent, thus allowing the user to view and select a number of coupons simultaneously. The invention 1 can accommodate variously sized coupons, and panels 3 may be added to increase storage capacity. Additionally, the user can access the proper item without having to remove or sift through stacks of other coupons. The upper pocket 6 provides a highly visible and accessible storage area for frequently used coupons, or those which the shopper must be reminded to use.

Although the coupon container and the method of using the same according to the present invention has been described in the foregoing specification with considerable details, it is to be understood that modifications may be made to the present invention which do not exceed the scope of the appended claims and modified forms of this invention done by others skilled in the art to which the invention pertains will be considered infringements of this invention when those modified forms fall within the claimed scope of the invention.

What I claim as my invention is:

1. A holder and organizer for items comprising:

a holder having a pair of pivoting covers, said holder having means for detachably securing panels thereto, each panel having a first column and a second column of pockets attached thereto, said first column of pockets being larger than said second column of pockets, and wherein each of said pockets in said first and second columns have a top and bottom edge, and wherein said bottom edge of one pocket overlaps the top edge of an adjacent pocket.

2. The holder and organizer for items as claimed in claim 1, wherein each of said pockets in said first and second columns have a front face and a rear face, said front face being smaller than said rear face.

3. The holder and organizer for items as claimed in claim 2, wherein said front face is shaped as a triangle.

4. The holder and organizer for items as claimed in claim 1, wherein a plurality of additional panels are secured in the holder and organizer, each of said additional panels has an index tab attached to one edge.

5. The holder and organizer for items as claimed in claim 1, wherein at least one of said covers has at least one additional pocket which is pivotally attached thereto, whereby said said at least one additional pocket can be positioned inside or outside of said holder.

6. A holder and organizer for items comprising:

a holder having a pair of pivoting covers, said holder having means for detachably securing panels thereto, each panel having a first column and a second column of pockets attached thereto, said first column of pockets being larger than said second column of pockets, and wherein each of said panels has top, bottom and side edges defining a panel surface, and wherein at least one of said covers has at least one additional pocket which is pivotally attached thereto adjacent one of said top, bottom and side edges, said at least one additional pocket being movable from a first position wherein said at least one additional pocket is substantially outside said panel surface defined by said top, bottom and side edges, to a second position wherein said at least one additional pocket is substantially inside said panel surface defined by said top, bottom and side edges.

7. The holder and organizer for items as claimed in claim 6, wherein each of said pockets in said first and second columns have a top and bottom edge, and wherein said bottom edge of one pocket overlaps the top edge of an adjacent pocket.

8. The holder and organizer for items as claimed in claim 6, wherein each of said pockets in said first and second columns have a front face and a rear face, said front face being smaller than said rear face.

9. The holder and organizer for items as claimed in claim 8, wherein said front face is shaped as a triangle.

10. The holder and organizer for items as claimed in claim 6, wherein a plurality of additional panels are secured in the holder and organizer, each of said additional panels has an index tab attached to one edge.

* * * * *